US005802613A

United States Patent [19]

Marshall

[11] Patent Number: 5,802,613

[45] Date of Patent: Sep. 8, 1998

[54] NECKWEAR WITH HIDDEN DETACHABLE STORAGE POCKET

[76] Inventor: Ruth Marshall, 8372 University Ave., La Mesa, Calif. 91941

[21] Appl. No.: 775,446

[22] Filed: Dec. 30, 1996

[51] Int. Cl.[6] ..... A41D 25/00; A41D 27/20

[52] U.S. Cl. ..... 2/145; 2/144; 2/247

[58] Field of Search ..... 2/145, 144, 146, 2/147, 148, 149, 150, 151, 152.1, 153, 154, 155, 156, 157, 247, 248, 249, 250, 251, 252, 253, 254, 255, 300, 311, 312, 319, 301, 69, 69.5, 105, 106, 244, 243.1

[56] References Cited

U.S. PATENT DOCUMENTS

| | | | |
|---|---|---|---|
| 344,066 | 4/1886 | Fitzpatrick | 2/251 |
| 517,769 | 4/1894 | Selowsky | 2/144 |
| 1,310,125 | 7/1919 | Lundberg et al. | 2/247 |
| 1,550,134 | 8/1925 | Whitney | 2/144 |
| 2,389,697 | 11/1945 | Stoeckert | 2/247 |
| 2,557,445 | 6/1951 | Lewallen | 2/247 |
| 3,101,482 | 8/1963 | Rahjes | 2/247 |
| 3,206,765 | 9/1965 | Sherman | 2/144 |
| 3,950,790 | 4/1976 | Adler | 2/144 |
| 4,218,781 | 8/1980 | Lieberman | 2/247 |
| 4,602,390 | 7/1986 | Morera et al. | 2/247 |
| 5,073,987 | 12/1991 | Crosier | 2/247 |
| 5,435,011 | 7/1995 | Nicolai et al. | 2/247 |
| 5,454,119 | 10/1995 | Thomm | 2/247 |
| 5,617,587 | 4/1997 | Marchbanks | 2/247 |

*Primary Examiner*—Jeanette E. Chapman
*Attorney, Agent, or Firm*—Donn K. Harms

[57] ABSTRACT

A device for the storage of valuables in decorative fabric neckwear consisting of a hidden or stealth storage pocket removably attached to decorative neckwear such as a tie, scarf, ascot, or kerchief. The dismountable storage pocket may be removed and reattached to one or multiple pieces of neckwear having fasteners such as buttons, snaps, hook and loop, or other conventional fasteners mounted in positions corresponding to mating fasteners mounted upon the storage pocket. The dismountable storage pocket may be removed and remounted to many different pieces of decorative neckwear as a unit, without disturbing the contents of the storage pocket allowing the storage pocket to function as a wallet or purse for valuables while concurrently offering a non obvious hiding place for valuables or other contents.

12 Claims, 2 Drawing Sheets

NECKWEAR WITH HIDDEN DETACHABLE STORAGE POCKET

BACKGROUND OF THE INVENTION

1. Field of the Invention

This invention relates to neckwear. More particularly it relates to neckwear such as ties, ascots, and scarves which have a hidden pocket capable of easy selective removable attachment to and from, one or multiple pieces of neckwear having corresponding attachments thereon.

2. Prior Art

Millions of persons throughout the world chose to wear neckwear such as ties, ascots and scarves on a regular basis for a variety of reasons. Ties are worn by businessmen as an essential part of proper business attire or uniform. Ascots are a common feature of formal and informal neckwear. Such ties and ascots commonly feature a decorative side facing the viewer and an unseen side facing the wearer. Scarves and kerchief type neckwear are also commonly worn by both women and men on a regular basis.

However, one of the main functions of such decorative neckwear is just that, as decorative statement of fashion to the wearers daily wardrobe. Because of this commonly perceived function of such neckwear, it is also a perfect place to store valuables such as credit cards and identification instead of placing such items in an easily lost or stolen wallet or purse.

In formal dress situations or where the possibility of theft is highly possible, use of ties, ascots, or scarves to store the owner's most valuable personal possessions would offer the security of a stealth hiding place while concurrently alleviating the need to carry a wallet or purse. Small but infinitely valuable items such as drivers' license or other identification with addresses upon it, or, credit cards, bank checks, ATM cards, and other such electronic or non cash purchasing capabilities, can cause the owner great financial and legal harm if lost or stolen.

Currently, as noted, the favorite place of storage of such items is in the owner's purse or wallet. Usually credit cards, ATM cards, and identification cards are stored together in a manner making them easily transportable, all together, on a daily basis. By picking up a wallet or purse which contains these items and putting it in the pocket of the pants being worn on a given day, the owner may easily transport these indispensable credit and identification cards all at once.

There are however many times when placing these valuable items in one place such as a wallet makes them highly vulnerable to pickpockets, accidental loss by falling from the containing pocket or purse, or outright robbery. Thieves have wallets also, and, in the interest of the time constraints involved in a robbery, mugging, or pickpocketing, usually take the wallet from the individuals pants, or purse assuming the contents thereof to be similar in nature to most wallets and purses. Additionally, a wallet left in a car or on a table or desk, is an inviting prize to unscrupulous parties who assume the contents to be the normal mix if identification, cash, and electronic purchasing cards.

In a quest for hiding items which the owner wishes to remain safe and unseen, placing a pocket in neckwear such as a tie and benefits therefrom has been taught in prior art in a number of fashions.

U.S. Pat. No. 5,073,987 (Crosier) teaches a pocket formed in a necktie having a clear plastic on one wall of the formed pocket on the display side of the tie. However, the intent of Crosier is to display the contents of the pocket to viewing parties. Consequently, it would not be of use for storage of valuables unless the owner's intent in such storage is to invite someone to relieve him of the valuable contents of the pocket.

U.S. Pat. No. 4,835,821 (Durante) teaches a hidden pocket not on the tie, but on the back of a fabric mount which is buttoned to a shirt for securing a necktie upon the wearer's shirt. However, Durante is limited in size due to its mounting on the narrow shirt button strip and its need to be mounted on shirt buttons and could not be used with an ascot, scarf or kerchief type neckwear since such an attachment in not available. The small size taught by Durante would not allow for a number of credit cards, cash and identification, even when used with a neck tie. Additionally, the user's tie would have to be dismounted from the mount containing the pocket each time the owner wishes to use the contents of the pocket.

U.S. Pat. No. 5,435,011 (Nicolai) teaches a necktie having a pocket permanently mounted within the body of the tie between the decorative wall and the rear wall. Nicolai however is permanently sewed in place inside the tie and entry into, and removal of goods from the pocket, is inhibited by the need to fold back the rear wall of the tie. Since it is permanently attached to the interior of the tie, each time the user wishes to wear different neckwear, if the user needs the contents of the pocket it must be removed piece by piece and replaced in a wallet or another tie.

As such, there exists a need for conventionally manufactured neckwear such as ties, scarves, ascots, and the like, having a hidden detachable pocket. An additional need exists for such a detachable storage pocket device which would be capable of stealth or hiding while concurrently being easily adaptable to a multitude neckwear by simple detachment of the entire pocket with its entire contents from one piece of neckwear and reattachment, with all of its contents, to another such piece of neckwear. This would allow the storage pocket portion of the different versions of neckwear to operate as a wallet for the desired valuables. Such an ability eliminates the need to empty the contents of the storage pocket each time a new tie or scarf or other type of neckwear with hidden pocket mounting ability is worn by the user who wishes to hide valuables, cash or electronic debit cards.

A further need exists for neckwear with a removable pocket capable of variable size in case the owner desires to increase the size of the contents to be kept in the removable and remount able neckwear pocket or pouch. Such a variation in size would also allow for larger or additional separators in the storage pocket to sort or organize the contents therein.

SUMMARY OF THE INVENTION

Applicant's device is easily manufactured from conventional fabric or other materials currently used for neckwear such as ties, scarves, and kerchiefs which includes silk, cotton, polyester, rayon, mixtures thereof along with other conventional neckwear fabrics. By manufacturing the pocket with a fastener or multiple fasteners allowing for attachment to, or within, the tie, or scarf, the pocket is easily attached to a multitude or ties, ascots, scarves, or kerchiefs. Such an attachment ability would allow for use of the hidden storage pocket on neckwear when worn around the neck, in the hair, over the shoulder, or in an otherwise current or future fashionable style of the time.

Applicant's invention, uses a stealth or concealable pocket capable of multiple mountings to different pieces of neckwear such a tie, a kerchief, and scarf, or an ascot. The ability to mount to different pieces of neckwear is accomplished by the placement of mounting hardware such as snaps, zippers, buttons, hook/loop fabric, or other conventional mounting hardware upon the pocket with corresponding accepting mounting hardware upon the neckwear.

The pocket portion of the invention, can actually be part of the neckwear itself. This ability is enabled by manufacturing the pocket from fabric identical or compatible in design to the decorative fabric used for the neckwear, or by supplying a sleeve for the pocket made from such fabric. The pocket would therein be zippered or attached to the neckwear in a manner to make it a functional portion of the neckwear and with the compatible registerable design aspects rendering it hard to discern when viewed by others providing a stealth and un obvious location for valuables.

Where the neckwear is worn in a fashion other than around the neck, such as in the hair, over the shoulder, or around the waist, as fashion or function may dictate, the hidden pocket may be attached to the neckwear on the side abutting the wearer's person at an aperture located in the neckwear in a location allowing access from the decorative side of the neckwear. The user could gain access to the pocket through the aperture placed then to deposit or remove items from the hidden pocket. Such a construction would allow the user to easily take a scarf from around the neck and use it around the waist, over the shoulder, or in the hair, while still accessing the removable hidden pocket.

Of course the concealable or stealth storage pocket or purse, when manufactured to mount with corresponding mounting fastening devices on both the pocket and different pieces of neckwear, is capable of removal and remounting on multiple pieces and types of neckwear having the corresponding mounting fasteners. This allows for the attachment and removal of the pocket, and its entire contents, from one piece of neckwear to another piece of neckwear, in a single action without removing the contents. Thus the pocket could function much the same as a wallet or purse does at present offering the utility and convenience of storing the user's valuable documents, cash, and credit cards on a regular basis.

In summary, the present invention is an improvement over intake manifold cross sectional area altering devices now in use and known in prior art. It is novel and satisfies a long unmet need for an easily and inexpensively manufactured and used stealth or hidden storage pocket for valuables and identification.

The preferred current embodiment of the invention features a cylindrical shaped flat pocket having at least one resealable opening at one end. More openings may be provided in the pocket for business cards, identification, money, or other items, to orderly separate the contents of the pocket for easy transport to an alternative piece of neckwear. The pocket may be mounted upon the rear of a necktie, scarf, kerchief, or ascot, using snaps, hook and loop fabric, buttons, or other conventional manner of removable mating of fabrics. This is accomplished by the mounting of the fastener upon one exterior sidewall of the pocket without crossing through the interior storage area of the pocket in such mounting. This leaves the storage area of the pocket ready to accept valuables or other desired contents depending upon its configuration. By mounting the pocket using one side wall, the resealable opening may be accessed without dismounting the neckwear from the wearer.

As noted, if the mounting fastener or fasteners upon the pocket correspond to mating fasteners upon different neckwear, the pocket may be mounted and dismounted from a variety of ties, ascots, scarves, and other conventional neckwear without disturbing the contents of the pocket. In each case by using a sidewall mounting, the pocket entry aperture is accessible to the user without dismounting the neckwear from its attachment to the body. Further, by using snaps or hook and loop fabric such as Velcro®, the pocket is quickly and easily removed from the neckwear for access and thereafter easily reattached to the neckwear when accesses is finished.

An object of this invention is providing a concealable or hidden pocket for the storage of valuables which can be easily mounted or dismounted from a variety of neckwear.

Another object of this invention is to provide the additional benefit of a storage pocket or pockets which can function as a wallet for valuable storage while concurrently being easily attachable to a multitude of neckwear having mounting fasteners corresponding to those of the pocket.

A further object of this invention is to provide users with a safe and non obvious place to store identification and valuables in situations where carrying a wallet or purse would not be practical.

Another object of this invention is to provide such a storage means which will mount and dismount from the user's neckwear without disturbing the contents thereof thus allowing transport and storage of the contents without removal from the concealable pocket.

A further object of this invention is to provide the aforementioned benefits in an easily and inexpensively manufactured device which is easily adaptable to a wide range of neckwear including ties, scarves, ascots, and kerchiefs.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
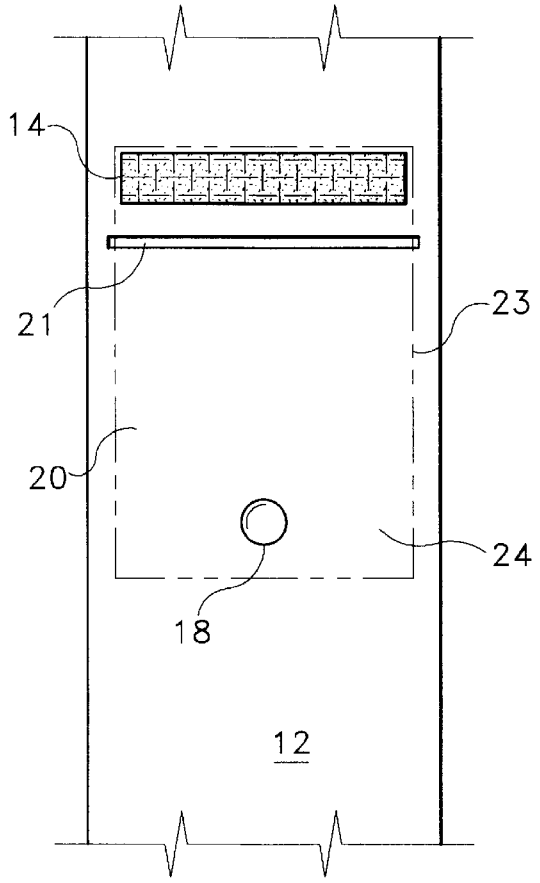
FIG. 1 is a rear view of a conventional necktie showing the attachment hardware for the dismountable pocket.

Referring now to the drawing Figures, specifically FIG. 1 depicts a preferred embodiment of the dismountable pocket invention showing a rear sectional view of a conventional necktie body 12 showing a hook/loop material 14 mount for the dismountable pocket body 20. The hook loop fabric is mounted upon the necktie body 12 on the rear out of view in a manner to correspond to mating hook/loop fabric 16 mounted upon the exterior area of the dismountable pocket 20. A zipper 26 or other conventional mounting such as a snap 18 or combinations thereof can also be used to provide a selectively removable mounting system to removably mount the pocket to the neckwear body depending upon the special requirements of the application. So long as the mounting hardware on the neckwear body is positioned to align with corresponding mounting hardware on the dismountable pocket 20, the pocket 20 can be easily mounted and dismounted from multiple pieces of neckwear without the need to remove the contents of the dismountable pocket 20 prior to each dismount and remount of the pocket. This is especially convenient if the user wishes to carry valuables, keys, identification, or other personal articles out of sight since the user can easily dismount the pocket 20 from one piece of neckwear and remount it to the corresponding mounts on a different piece of decorative neckwear. Consequently, the user could put the valuable containing dismountable pocket 20 on a necktie for one use, on the corresponding mounts to a scarf for a second use and on corresponding mounts on an ascot for a third use. All such relocations of the pocket can be accomplished without removing the contents of the dismountable pocket 20. In each case, the valuables and other personal items are hidden out of sight for owner safety and security and would allow the user the convenience of going without a bulky purse or a wallet when the occasion arises.

The dismountable pocket 20 is shown in phantom line contained in a pocket cavity 23 formed in a conventionally structured necktie between the fabric sidewalls inside the necktie body 12. In use the user would mount the pocket to the necktie or other decorative neckwear body 12 using the corresponding hook/loop fastener material 14 inserting the dismountable pocket 20 through an aperture 21 allowing communication thereto from outside the neckwear body which located in one sidewall in the necktie body 12 into the pocket cavity formed in the tie body 23.

The dismountable pocket 20 could also be mounted at the exterior of the decorative neckwear body 12 by using the hook/loop fabric 14 and a snap fastener or other conventional fabric mounts 18 combinations thereof mounted in positions corresponding to mating mounting hardware on the dismountable pocket 20.

Figure 2:
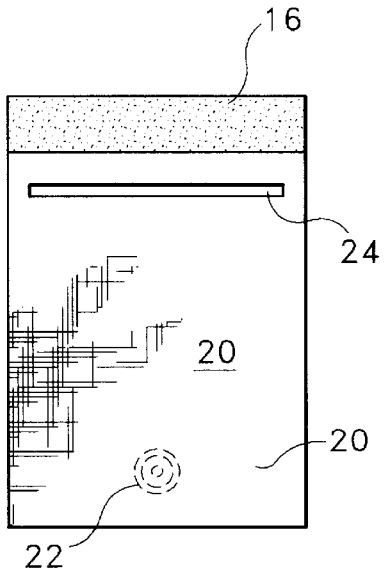
FIG. 2 is view of the dismountable pocket body using a hook/loop fabric mount.

FIG. 2 is view of the dismountable pocket body 20 using a hook/loop fabric mount 16 which corresponds to the position of the hook/loop fabric 14 on the decorative neckwear 12. A pocket entry aperture 24 is positioned at the top of the dismountable pocket 20 such that the aperture 24 allows the user access to the interior of the dismountable pocket 20 whether the pocket 20 is placed inside the neckwear in a formed pocket cavity, or mounted outside the neckwear body using a system of aforementioned corresponding mounting hardware. The pocket entry aperture 24 in all embodiments may have an optional aperture closure device such as a zipper or other closure fastener to keep the entry aperture sealed.

Figure 3:
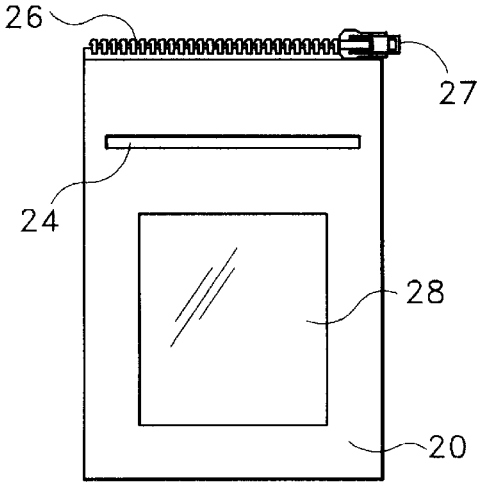
FIG. 3 is a view of the dismountable pocket body using a zipper mount and having a display pocket for identification.

FIG. 3 is a view of the dismountable pocket body 20 using a zipper mount 26 which attaches in a conventional zipper fashion to the corresponding second half of the zipper mounted upon the body of the neckwear. Other conventional mounts such as hook and loop fabric or corresponding snaps could be used for attachment to the neckwear body. A pocket entry aperture 24 is positioned at the top of the dismountable pocket 20 such that the aperture 24 allows the user access to the interior of the dismountable pocket 20 whether the pocket 20 is placed inside the neckwear in a formed pocket container, or mounted outside the neckwear body using a system of aforementioned corresponding mounting hardware. Additional access apertures 24 may be added as needed or desired to hold business cards, credit cards, or other valuables in separated positions in the removable pocket 20. Optionally, a transparent wall 28 formed from plastic or other clear material can be placed in the sidewall of the dismountable pocket 20 to form a section to hold identification which would remain hidden on the person's body side of the neckwear or on the aforementioned interior of the neckwear until needed. In this manner the user can dismount the dismountable pocket 20 from the neckwear to show identification if needed without disturbing the contents of the dismountable pocket 20 itself.

Figure 4:
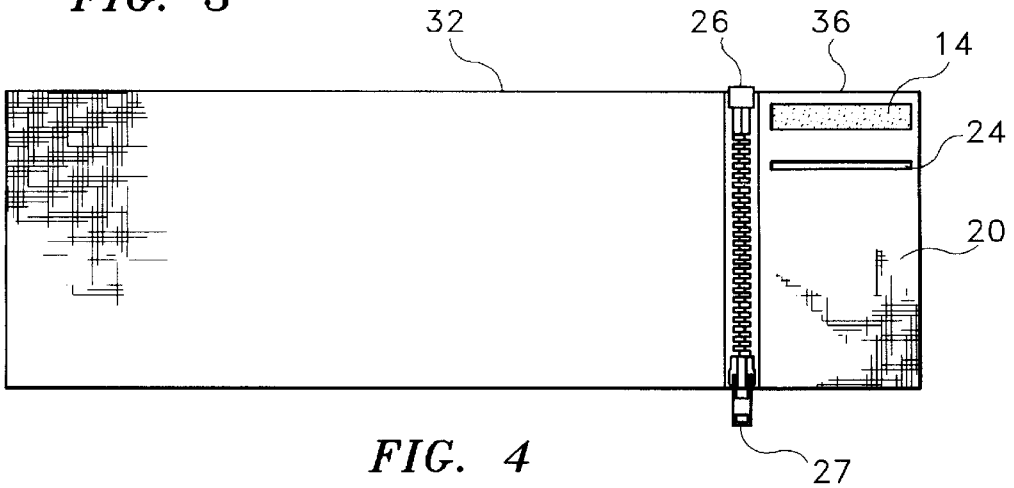
FIG. 4 depicts a scarf type decorative neckwear having a dismountable pocket body as part of the scarf.

FIG. 4 depicts a scarf type decorative neckwear having a dismountable pocket body 20 as part of the scarf type decorative neckwear body 32. This is accomplished using a zipper 26 or other conventional fabric mounts such as hook and eye fabric or snaps, in a conventional removable mounting wherein one edge of the dismountable pocket 20 attaches to the one edge of the scarf type neckwear body 32 when the zipper 26 is zipped. One or more pocket entry apertures 24 allow access to the contents of the dismountable pocket 20. If the pocket 20 is formed of the same fabric design and color as the scarf neckwear body 32 the pocket 20 would blend and be hidden in a stealth fashion. A neutral fabric for the body of the dismountable pocket 20 could be used allowing for mounting and dismounting the pocket portion 20 to multiple scarves, neckties, or ascot style decorative neckwear while still being stealth or hidden.

Optionally, the scarf type neckwear could use hook and loop fabric 14 or other conventional mounting hardware to allow for the mounting of the selectively removable pocket 20 inside of an optional pocket cavity 23 formed n the body 32 accessed through the pocket entry aperture 24. In this fashion the detachable portion of the decorative neckwear would function as a sleeve to contain the dismountable pocket 20.

Figure 5:
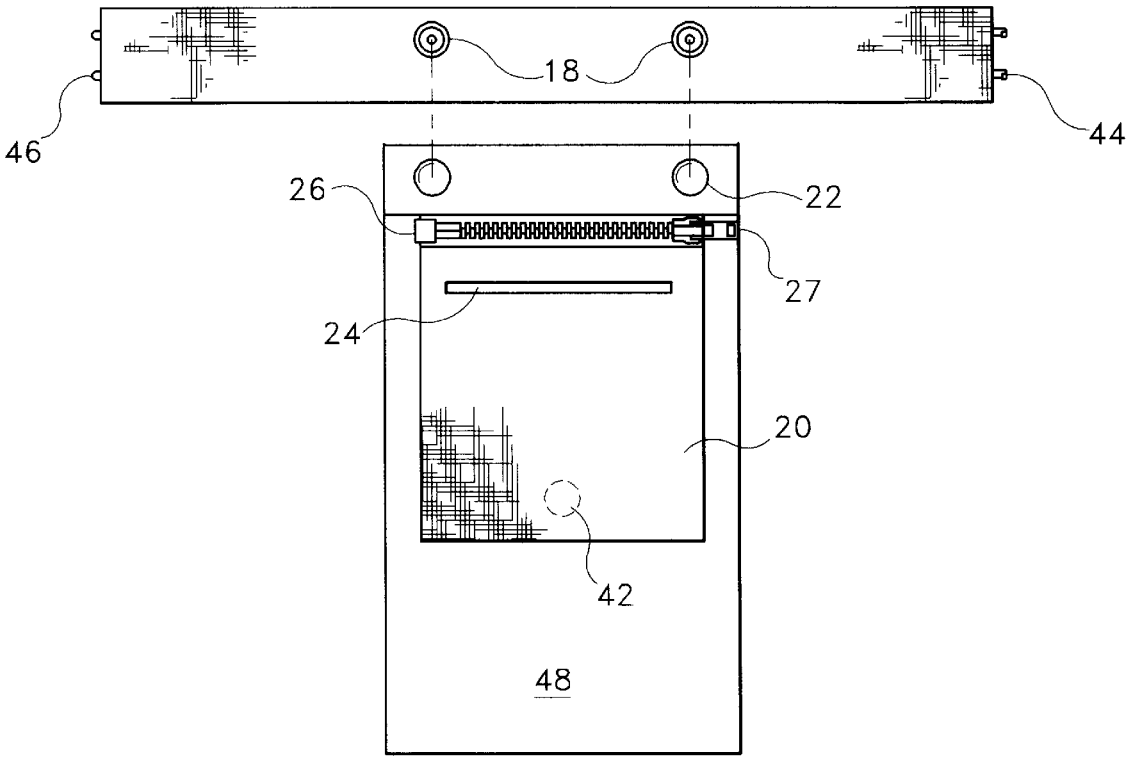
FIG. 5 depicts an ascot style of decorative neckwear showing the dismountable pocket body attached to the rear of the breastplate portion of the neckwear.

FIG. 5 depicts an ascot style of decorative neckwear showing the dismountable pocket body 20 attached to the rear of the breastplate portion 48 of the decorative neckwear. This embodiment would allow for the mounting and dismounting of the pocket 20, in a similar manner to that of the necktie version of decorative neckwear. With the mounting hardware placed on one wall on the breastplate 48 corresponding to that of one wall of the pocket 20 and with other neckwear also having corresponding types and locations of mounting hardware such the necktie body 12, or the scarf 32, the pocket 20 is easily mounted and dismounted to multiple pieces of decorative neckwear. Again, as in the necktie, a pocket container 23 could be formed between the two sidewalls and on interior of the breastplate 48 to allow for insertion of one end of the pocket 20 inside the breastplate 48 through a corresponding aperture in the sidewall of the breastplate. This style of decorative neckwear is mounted on ones person using the conventional hooks 44 mating to corresponding eyes 46 when the neck portion 42 is wrapped around the user's neck. The breastplate portion 48 is mounted to the neck portion 42 using snaps 18 and 22 or other conventional mounting hardware. If all of the types and positions of the various mounting hardware on the removable pocket correspond to the mounting hardware on different pieces of decorative neckwear such as a tie 12 or an ascot breastplate 48, or a scarf 32 and 50, the removable pocket 20 could be mounted and dismounted to any of the neckwear depending upon what type is worn, all without need to remove the contents of the pocket 20. The user thus has a system for locating valuables and identification in a hidden or stealth location by using the pocket on numerous types and pieces of neckwear.

Figure 6:
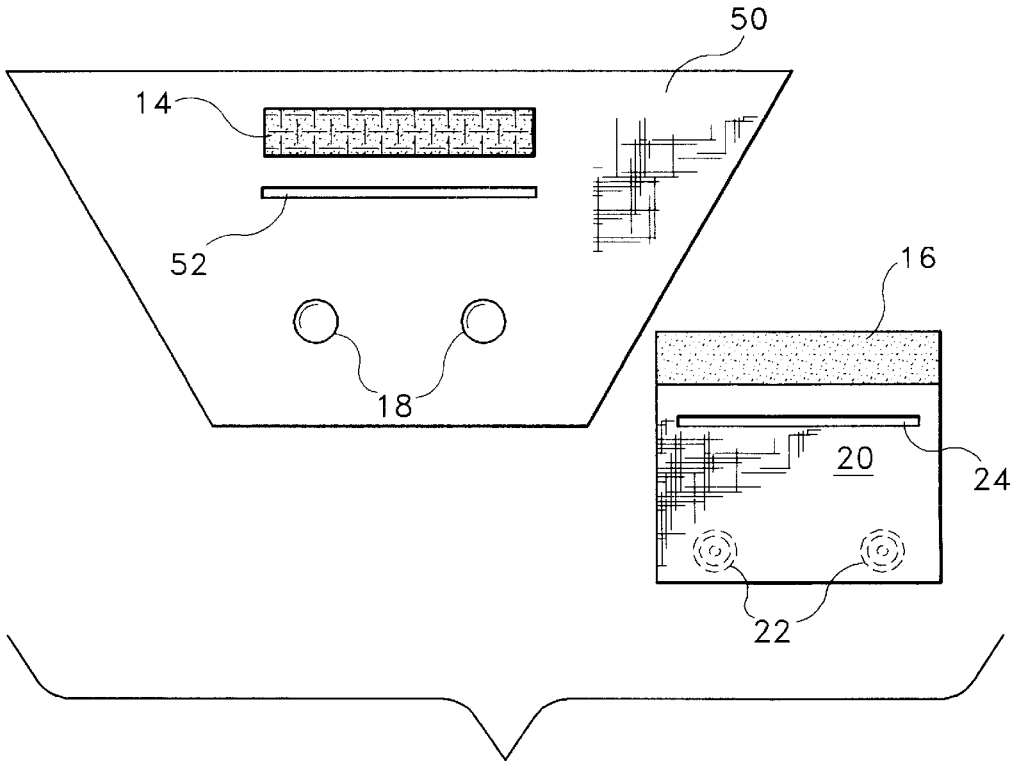
FIG. 6 depicts a scarf type of decorative neckwear showing a slit in the scarf which corresponds to the pocket entry aperture of the dismountable pocket.

FIG. 6 depicts a scarf type of decorative neckwear 50 showing a slit 52 positioned in the scarf body which corresponds to the pocket entry aperture 24 of the dismountable pocket 22. This arrangement allows access to the interior portion of the selectively dismountable pocket 20 and its contents by reaching through an aperture located through the neckwear body to the front of the neckwear. Mounting the pocket as noted with the aforementioned other neckwear types would be accomplished using corresponding hook/loop fabric 16 or snaps 22 or other conventionally used mounting hardware and combinations thereof which mates with conventional mounting hardware on the decorative neckwear body. This scarf type of decorative neckwear 50 and 32 can also be worn over the shoulder or around the user's waist as has become fashionable thus allowing the user to carry valuables, identification, or other desired items in the hidden removable pocket 22 while in place in other areas of the user's body.

While all of the fundamental characteristics and features of the neckwear with hidden detachable storage pocket have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. An apparatus for the storage of valuables in a neckwear body comprising:

a storage pocket comprising:

a first side wall having an interior surface, and having an exterior surface, a second side wall having and interior surface and having an exterior surface connected to said first side wall;

a storage cavity of said storage pocket defined by the area of said first side wall interior, surface and said second sidewall interior. surface;

an exterior surface of said storage pocket defined by the area of the exterior surface of said first side wall and said second side wall;

a storage cavity access aperture communicating with said storage cavity and said exterior, surface of said storage pocket;

means for removable attachment of said storage pocket to any one neckwear body of a plurality of neckwear bodies; and said neckwear body is comprised of two neckwear side walls forming an interior cavity area of said neckwear body therebetween and having a pocket receiving cavity located in said interior cavity area of said neckwear body, said pocket receiving cavity communicating through one of the side walls of said neckwear body, said pocket receiving cavity sized to accommodate said storage pocket therein whereby a portion of said storage pocket may be removeably mounted inside of said pocket receiving cavity by insertion of said storage pocket therein.

2. The invention as defined in claim number 1 wherein said means for removable attachment consists of hook and loop fastener material mounted upon said exterior surface of said storage pocket removably mountable to corresponding hook and loop fastener material mounted upon said neckwear body.

3. The invention as defined in claim number 1 wherein said means for removable attachment consists of snap fasteners mounted upon the exterior surface of said storage pocket removably mountable to corresponding cooperating snap fasteners located upon said neckwear body.

4. The invention as defined in claim number 1 wherein said means for removable attachment consists of a combination of fasteners comprised of snap fasteners and hook and loop fastener material mounted upon the exterior surface of said storage pocket said combination of fasteners removably mountable to a corresponding combination of fasteners located upon said neckwear body.

5. The invention as claimed in claim 1 wherein said means for removable attachment comprises a zipper having a first zipper side removably attachable to a second zipper side using a zipper attaching slide, said first zipper side mounted to said neckwear body and said second zipper side of said zipper mounted to said exterior surface of said storage pocket whereby said storage pocket may be removably attached to said neckwear body by the removable attachment of said first zipper side to said second zipper side using the attaching zipper slide.

6. The invention as claimed in claim 1 additionally comprising said means for removable attachment being positioned in location whereby said storage pocket is substantially hidden from view when removably attached to said neckwear body.

7. The invention as claimed in claim 1 wherein said neckwear body is a necktie.

8. The invention as claimed in claim 1 wherein said neckwear body is an ascot.

9. The invention as claimed in claim 1 wherein said neckwear body is a scarf.

10. The invention as claimed in claim 1 wherein a decorative design of fabric forming said one of said neckwear body registers with a decorative design of fabric forming said exterior surface of said storage pocket whereby said exterior surface of storage pocket blends into the design of said fabric forming said one neckwear body rendering said exterior surface of said storage pocket visually hard to discern.

11. The invention as claimed in claim 1 wherein said neckwear body is shaped to allow said neckwear body to be worn around the waist.

12. The invention as claimed in claim 1 wherein said neckwear body is shaped to allow said neckwear body to be worn over the shoulder.

* * * * *